US008743016B2

(12) United States Patent
Lee et al.

(10) Patent No.: US 8,743,016 B2
(45) Date of Patent: Jun. 3, 2014

(54) ANTENNA WITH TAPERED ARRAY

(75) Inventors: Jae Seung Lee, Ann Arbor, MI (US); Paul Donald Schmalenberg, Ann Arbor, MI (US); Amin Rida, Atlanta, GA (US); Ronglin Li, Norcross, GA (US); Emmanouil M. Tentzeris, Atlanta, GA (US)

(73) Assignees: Toyota Motor Engineering & Manufacturing North America, Inc., Erlanger, KY (US); Georgia Tech Research Corporation, Atlanta, GA (US)

( * ) Notice: Subject to any disclaimer, the term of this patent is extended or adjusted under 35 U.S.C. 154(b) by 308 days.

(21) Appl. No.: 12/883,862

(22) Filed: Sep. 16, 2010

(65) Prior Publication Data

US 2012/0068909 A1 Mar. 22, 2012

(51) Int. Cl.
*H01Q 1/38* (2006.01)
*H01Q 9/04* (2006.01)
*H01Q 21/00* (2006.01)

(52) U.S. Cl.
USPC ..... 343/893; 343/700 MS

(58) Field of Classification Search
CPC ..... H01Q 1/38; H01Q 9/0407; H01Q 9/0457; H01Q 9/0485; H01Q 9/0471; H01Q 3/26; H01Q 3/2605; H01Q 3/2664; H01Q 3/28; H01Q 21/0075; H01Q 21/22; H01Q 21/061; H01Q 21/065
USPC ..... 343/842, 893
See application file for complete search history.

(56) References Cited

U.S. PATENT DOCUMENTS

| | | | | |
|---|---|---|---|---|
| 5,017,931 | A * | 5/1991 | Carlyon | 343/700 MS |
| 5,287,116 | A * | 2/1994 | Iwasaki et al. | 343/700 MS |
| 5,694,134 | A * | 12/1997 | Barnes | 343/700 MS |
| 7,573,388 | B2 * | 8/2009 | Khatri | 340/572.7 |
| 2006/0044189 | A1 * | 3/2006 | Livingston et al. | 343/700 MS |
| 2006/0097921 | A1 | 5/2006 | Luk et al. | |
| 2006/0232490 | A1 | 10/2006 | Bisiules et al. | |
| 2006/0284770 | A1 | 12/2006 | Jo et al. | |
| 2007/0109201 | A1 | 5/2007 | Licul et al. | |
| 2009/0027267 | A1 | 1/2009 | Carter et al. | |
| 2009/0213024 | A1 | 8/2009 | Hsieh et al. | |
| 2009/0274072 | A1 | 11/2009 | Knox | |
| 2010/0056191 | A1 | 3/2010 | Eldering | |

* cited by examiner

*Primary Examiner* — Hoang V Nguyen
*Assistant Examiner* — Patrick Holecek
(74) *Attorney, Agent, or Firm* — Gifford, Krass, Sprinkle, Anderson & Citkowski, P.C.

(57) ABSTRACT

An antenna with improved radiation efficiency is provided. The antenna includes an antenna array proximately coupled to a feed line. The antenna array includes a plurality of resonating lines. Each resonating line includes a plurality of axially aligned resonators. The resonators have a resonating surface. The resonating surfaces of the resonators at the ends of the resonating lines are larger than resonating surfaces of the resonators in the middle of the resonating lines. Power is supplied to each resonating ling through a feed line. Electrical field is uniformly distributed along the antenna array so as to improve the radiation efficiency of the antenna.

5 Claims, 3 Drawing Sheets

ANTENNA WITH TAPERED ARRAY

FIELD OF THE INVENTION

The invention relates to an antenna configured to improve radiation efficiency.

BACKGROUND OF THE INVENTION

Current radar systems operating at the microwave range include an antenna. The antenna includes an array of resonating elements mounted onto a substrate. The antenna array includes a plurality of resonating lines. Each resonating line includes a plurality of axially aligned resonators. Power is supplied to each resonating line through a feed line.

In certain embodiments, the feed line is proximately coupled to each of the resonating lines. The feed lines are mounted on the substrate and are generally disposed beneath the resonating lines. Electricity is supplied along the feed lines, actuating the resonators so as to receive echoes from a transmitting antenna. However, a concentration of electrical field forms along the mid portion of the antenna array, as shown in FIG. 1. This concentration affects the radiation efficiency of the antenna, and may generate a side lobe (as shown in FIG. 4) which may affect the accuracy of the antenna.

Accordingly, it remains desirable to have an antenna having an array proximately coupled to the feed line which reduces the concentration of electrical field along the mid portion of the antenna array.

SUMMARY OF THE INVENTION

According to one aspect of the invention, an antenna for use in an automobile is provided. The antenna includes an array proximately coupled to a feed line. The antenna array includes a plurality of resonating lines. Each resonating line includes a plurality of axially aligned resonators. Power is supplied to each resonating line through the feed line. The resonators have a resonating surface. The resonating surfaces of the resonators at the ends of the resonating lines are larger than resonating surfaces of the resonators in the middle of the resonating lines.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Figure 1:
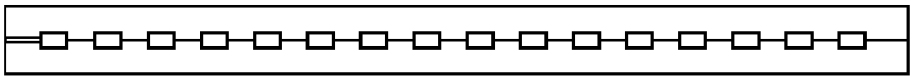
FIG. 1 Prior Art
FIG. 1 is an illustration of a prior art antenna.
Figure 2:
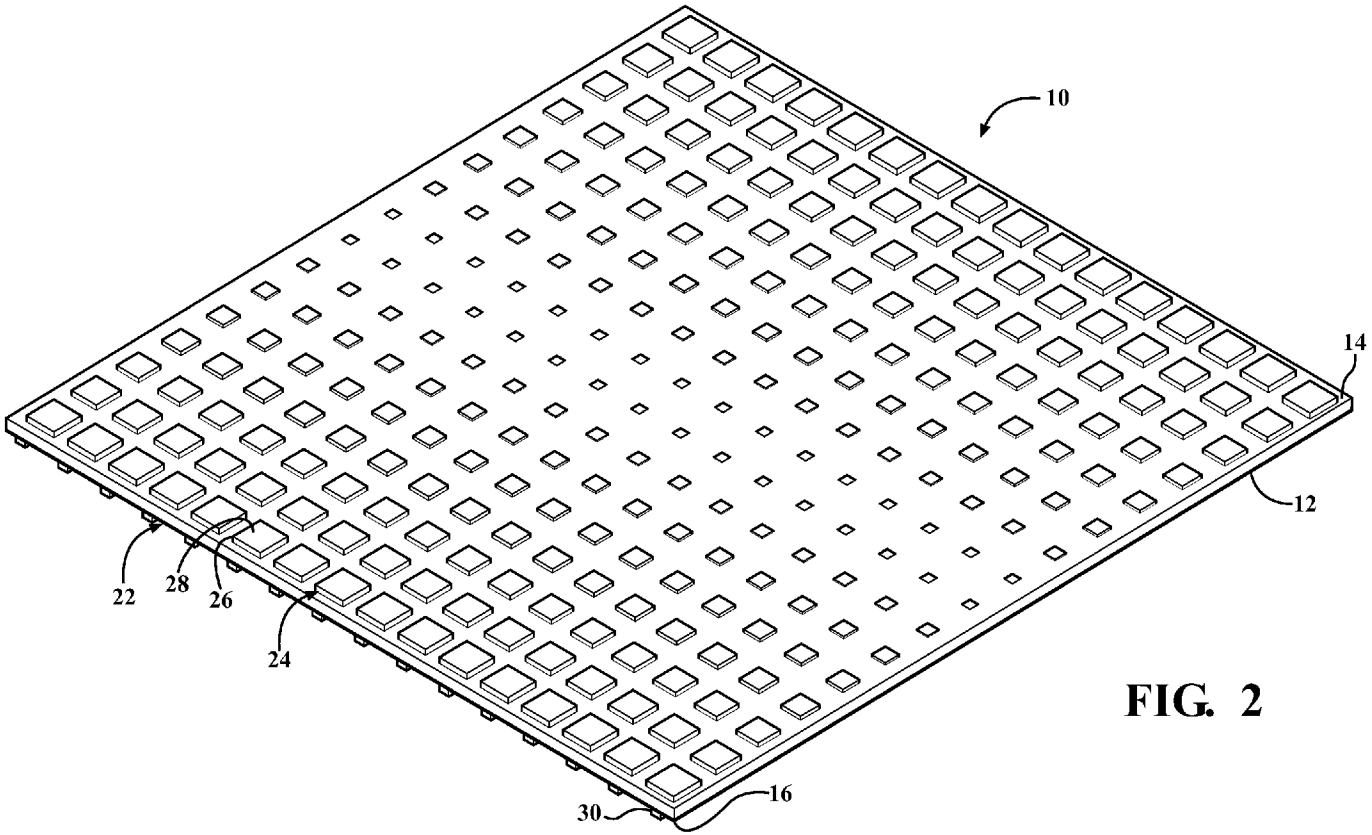
FIG. 2 is an illustrative view an antenna of the present invention.

With reference first to FIG. 2, an antenna 10 having a uniform distribution of an electrical field is shown. The uniform distribution of electrical field improves the radiation efficiency of the antenna 10 and reduces the size of side lobes.

Figure 3:
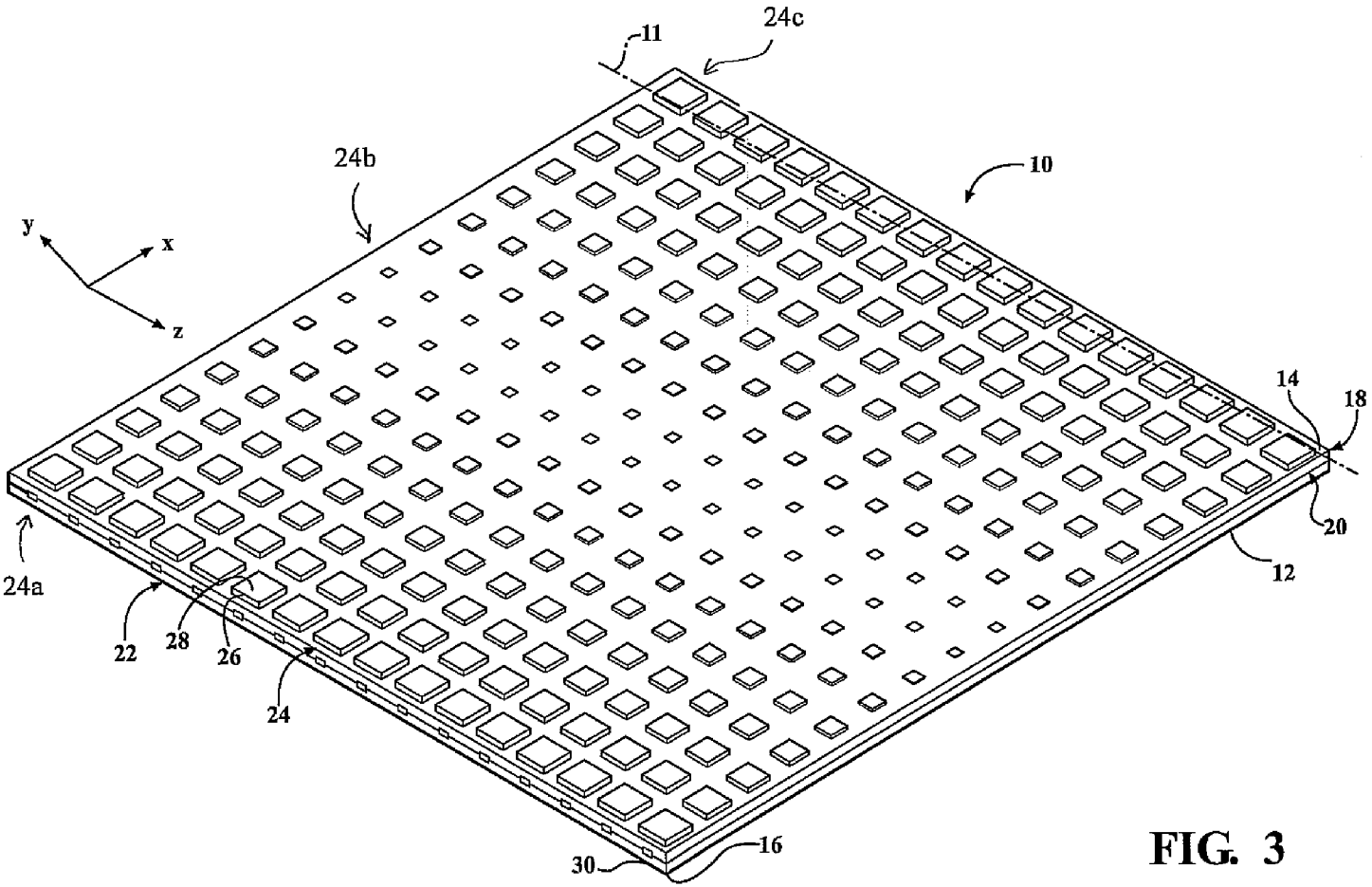
FIG. 3 is a perspective view of an antenna having two layers.

The antenna 10 includes a substrate 12 formed of a dielectric material. The substrate 12 includes a first surface 14 opposite a second surface 16. The substrate 12 may be formed as a single layer as shown in FIG. 2. Alternatively, the substrate 12 may be formed of multiple layers 18, 20 of dielectric material, as shown in FIG. 3. The substrate 12 has a predetermined thickness configured to optimize the radiation efficiency of the antenna 10.

An antenna array 22 is disposed on the first surface 14 of the substrate 12. The antenna array 22 has a plurality of resonating lines 24, and each resonating line 24 has a plurality of resonators 26 axially aligned to each other. Each of the plurality of resonating lines 24 includes a first resonating end 24*a* spaced apart from a second resonating end 24*c*, and a center resonating portion 24*b* disposed between the first and second resonating ends 24*a*, 24*c*. Each of the plurality of resonators 26 has a resonating surface 28. The resonating surfaces 28 of the resonators 26 at the first and second resonating ends 24*a*, 24*c* of the resonating line 24 are larger than the resonating surfaces 28 of the resonators 26 in the center resonating portion 24*b* the resonating line 24. Thus the resonators 26 are tapered from the ends of the resonating line 24 to the middle of the resonating line 24.

A plurality of feed lines 30 provides power to the antenna 10. More specifically, each feed line 30 is proximately coupled to a resonating line 24 in the antenna array 22. The feed line 30 is formed of an electrical conductive material such as copper, gold or the like. The feed line 30 has a predetermined width that is configured to generate a desired impedance at each of the resonators 26. The feed lines 30 are spaced apart from the resonating lines 24. Each feed line 30 is axially aligned with and generally directly below a corresponding resonating line 24.

With reference again to FIG. 2 and now to FIG. 3, the operation of the antenna 10 is provided. The antenna array 22 is mounted on the first surface 14 of the substrate 12. The antenna array 22 includes sixteen resonating lines 24. Each of the resonating lines 24 includes sixteen resonators 26. The resonators 26 are spaced equally apart from each other along each resonating line 24. The surface area of the resonators 26 at the end of each resonating line 24 is larger than the surface are of the resonators 26 in the middle of the resonating line 24.

The feed line 30 is proximately coupled to each of the resonating lines 24. As shown in FIG. 3, the feed lines 30 are disposed on the second surface 16 of the substrate 12. However, it is anticipated that the feed lines 30 may be sandwiched between a first and second layer 18, 20 of dielectric material as shown in FIG. 3.

Electricity is supplied to each feed line 30, actuating the individual resonators 26. The electricity creates a magnetic inductance which excites the resonators 26. As each resonator 26 is excited, an electrical field is generated. The strength of the electrical field is dependent upon the amount of electricity supplied along the feed line 30 and the size of the resonating surfaces 28 of the resonators 26.

The electrical field accumulates along the middle of the antenna array 22 due to the excitement of adjacent resonators 26. Since there is a large concentration of resonators 26 in the middle of the antenna array 22, a larger concentration of electrical field is found in the middle of the antenna array 22. As known in proximately coupled arrays 22 of the prior art, the concentration of electrical field reduces the radiation efficiency of the resonators 26.

The present invention overcomes this problem by reducing the magnitude of the electrical field generated by each of the resonators 26 in the middle of the antenna array 22. This is done by having the resonating surface 28 of the resonators 26 in the middle of the antenna array 22 smaller than the resonating surface 28 of the resonators 26 at the ends of the resonating lines 24.

The electrical field in the middle of the antenna array 22 is still accumulated. However, since the electrical field generated by the resonators 26 in the middle of the array 24 is smaller, the concentration of the electrical field in the middle may be configured to be the same as the electrical field generated at the ends of the resonating lines 24. Thus, the electrical field is generally uniform along each of the resonating lines 24. The uniform electrical field along the antenna array 22 improves the radiation efficiency of the antenna 10 relative to prior art antennas.

Figure 4:
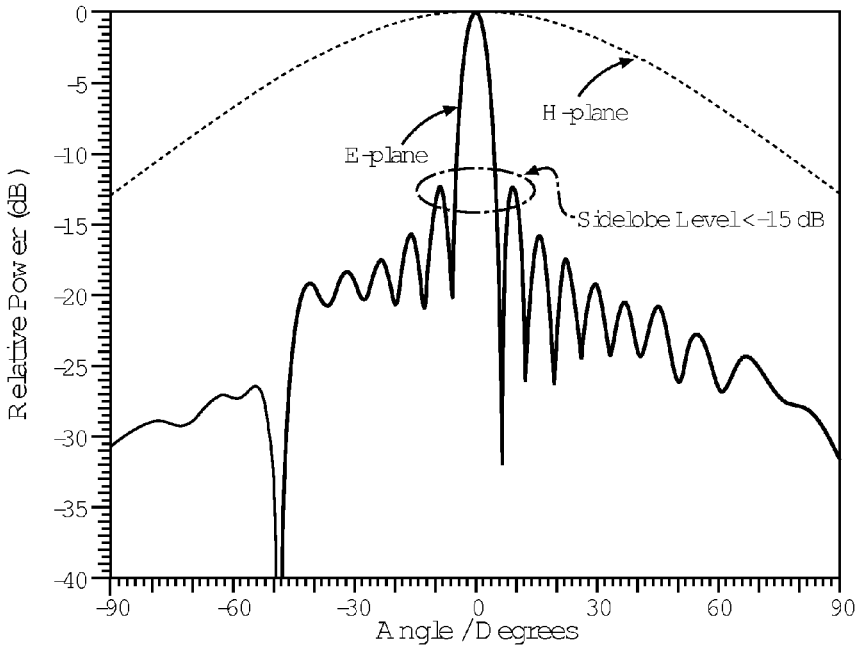
FIG. 4 is a diagram showing the processed echos from a prior art antenna.
Figure 5:
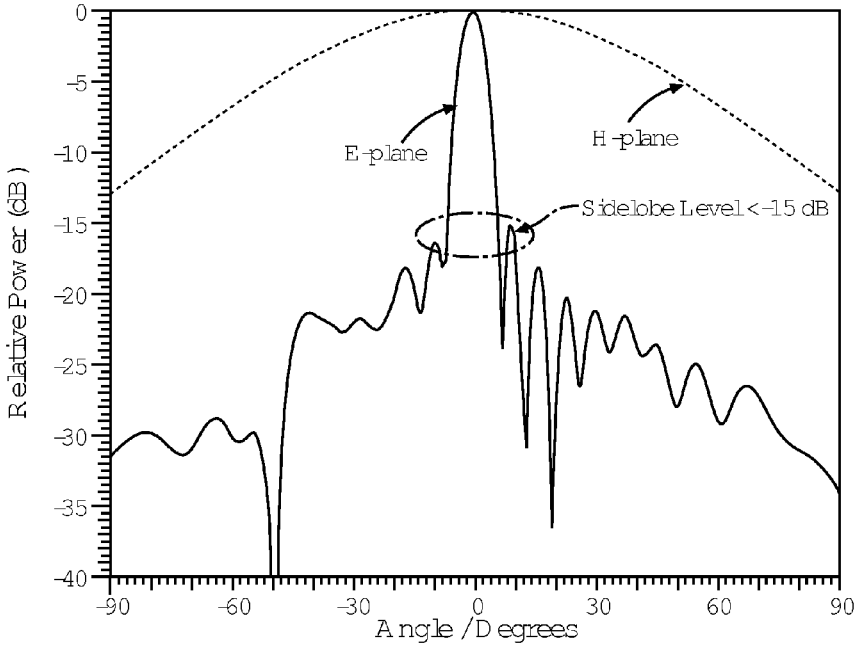
FIG. 5 is a diagram showing the processed echos from an antenna of the present invention.

With reference now to FIG. 5, a chart is provided. The chart provides experimental data. The data shows the reduction in side lobes relative to a proximately coupled non-tapered antenna array 22 having the same number of resonators 26, operating at the same frequency, as shown in FIG. 4. Specifically, the tapered antenna array 22 antenna 10 of the present invention has side lobes less than fifteen dB, whereas the antenna of the prior art has side lobes greater than fifteen dB.

The invention has been described in an illustrative manner. It is therefore to be understood that the terminology used is intended to be in the nature of the words of description rather than limitation. Many modifications and variations of the invention are possible in light of the above teachings. For example, the antenna 10 may include thirty-two resonating lines 24, each having thirty-two resonators 26. Thus within the scope of the appended claims the invention may be practiced other than as specifically described.

The invention claimed is:

1. An antenna configured to generate a uniform distribution of an electrical field, the antenna comprising:

a substrate formed from a dielectric material, the substrate having a first surface opposite a second surface;

a plurality of feed lines, each of the plurality of feed lines extending along an axis from a first end of the substrate to a second end of the substrate; and an antenna array disposed on the first surface of the substrate, the antenna array proximately coupled to the feed line, the antenna array having a plurality of resonating lines, each of the plurality of resonating lines having a first resonating end spaced apart from a second resonating end, and a center resonating portion disposed between the first and second resonating ends, each resonating lines having a plurality of resonators axially aligned and each of the resonating lines is aligned along the axis of a corresponding feed line in the plurality of the feed lines, each of the plurality of resonators having a resonating surface, the resonating surfaces are larger at the first and second resonating ends than the resonating surfaces in the center resonating portion of the resonating line so as to produce a smaller electric field in the center of the substrate resulting in a generally uniform electric field throughout the substrate and along the respective feed lines.

2. The antenna as set forth in claim 1, wherein the substrate includes a first layer and a second layer, the feed line disposed between the first and second layer of the substrate.

3. The antenna set forth in claim 1, wherein the plurality of resonators is spaced equally apart from each other.

4. The antenna as set forth in claim 1, wherein the area of the resonating surfaces of the resonators becomes smaller as the resonators are disposed further away from respective ends of the resonating lines.

5. The antenna as set forth in claim 1, wherein each of the resonators of each of the plurality of resonating lines are disposed along a common axis with an adjacent resonator of an adjacent resonating line.

* * * * *